United States Patent [19]

Schön

[11] Patent Number: 4,611,902

[45] Date of Patent: Sep. 16, 1986

[54] ROLLER FOR PRESSING A SHEET AGAINST A HEATING SURFACE

[75] Inventor: Klaus-Peter Schön, Wiesbaden, Fed. Rep. of Germany

[73] Assignee: Hoechst Aktiengesellschaft, Frankfurt am Main, Fed. Rep. of Germany

[21] Appl. No.: 664,325

[22] Filed: Oct. 24, 1984

[30] Foreign Application Priority Data

Oct. 31, 1983 [DE] Fed. Rep. of Germany ..... 3339463

[51] Int. Cl.[4] ..... G03G 15/00; B21B 31/08

[52] U.S. Cl. ..... 355/3 FU; 355/14 FU; 219/216; 29/128; 29/132

[58] Field of Search ..... 355/3 FU, 14 FU; 219/216, 385, 388; 118/60, 651, 661; 29/110, 121.4, 124, 127, 128, 130, 132, 116 R; 100/93 RP, 155, 176

[56] References Cited

U.S. PATENT DOCUMENTS 1,945,274 1/1934 Hormel ..... 29/127
2,630,657 3/1953 Hanley ..... 29/127
2,960,753 11/1960 Robertson ..... 29/116 R
4,059,394 11/1977 Ariyama et al. ..... 432/59
4,474,456 10/1984 Kobayashi et al. ..... 355/14 FU

FOREIGN PATENT DOCUMENTS 1440502 6/1976 United Kingdom ..... 355/3 FU

*Primary Examiner*—Arthur T. Grimley
*Assistant Examiner*—C. Romano
*Attorney, Agent, or Firm*—Schwartz, Jeffery, Schwaab, Mack, Blumenthal & Evans

[57] ABSTRACT

A roller 1 which serves to press a copy sheet against a heating plate of a fixing device in an electrophotographic copier is equipped with a clinging plastic tape 3 wound spirally around the roller. The end portions 6,6' of the roller are provided with clamping means. The tape 3 has holes and pointed ends. The roller ends have different lengths, and over the longer roller end 10 a clamping sleeve 4 is slipped and is mounted on a shaft, thus forming the end portion 6'. The clamping sleeve has a tapped hole penetrating its wall and provided with a set screw which is screwed down to lock the clamping sleeve, which is otherwise rotatable about the shaft, in a position in which the tape is wound tightly around the roller surface.

11 Claims, 6 Drawing Figures

ROLLER FOR PRESSING A SHEET AGAINST A HEATING SURFACE

BACKGROUND OF THE INVENTION

The present invention relates to a roller which serves to press a sheet against a heating surface and which has a textured surface.

Rollers of the above-indicated kind are used in a fixing device which is incorporated in a copier and in which a toner image which has been developed with a developing liquid is fixed on a paper sheet by the application of heat. Such a fixing device is, for example, provided with a curved heating plate or heating surface, and the copy sheet carrying the liquid-developed toner image is guided through the fixing device and passed over the heating plate by means of a guide roller, i.e., a roller for pressing the copy sheet against the heating plate. The heating plate or heating surface, is heated by a correspondingly-shaped heating apparatus.

A thermal fixing station is used in electrophotographic copiers, in which a charge image produced on a photoconductor layer is developed to form a toner image, with the aid of a developing liquid containing toner pigments which are deposited on the charge image. The toner image is thereafter transferred to a copy base, for example, a paper sheet. The copy base, which carries the toner image and is moist with developing liquid, is introduced into the thermal fixing device, where the toner image is fixed on the paper and rendered smear-resistant by the application of heat.

German Offenlegungsschrift No. 25,039,642 discloses a device for fixing a toner image with the aid of heat. This fixing device is installed in an electrophotographic copier using a liquid developer. A heating apparatus is arranged in the fixing device. The liquid-developed copy sheet, which has the toner image on its upper surface, is conveyed past this heating apparatus, part of a heating surface of which is curved. The copy sheet contacts the curved heating surface with its reverse side and slides over the surface so that the toner image is fixed by heat. A roller is arranged at a short distance from the heating surface and is brought into contact with the surface of the sheet carrying the toner image, in order to convey the sheet to the curved area of the heating surface and transport it over the heating surface. The roller has a knurled peripheral surface and its distance from the bent or curved surface area of the heating surface is greater than the thickness of the sheet.

In copiers of the prior art, in which liquid developers are employed, knurled anodized aluminum rollers are used to press the copy base against the heating plate. If a developing liquid which deposits a greater amount of toner than conventional developing liquids is used in such a copier, it may happen that the still-soft toner is dragged along by the small knobs of the knurled aluminum roller and is retransferred to the copy base, after a complete revolution of the aluminum roller. The known knurled pressure rollers must be replaced after a particular operating time, since, on the one hand, too much toner settles in the grooves between the knobs of the knurled surface and soils the copy bases and, on the other hand, the knobs wear out, so that the copy base is no longer perfectly pressed against the heating surface, and sufficient fixing is thus no longer ensured. Replacing the pressure roller involves a prolonged downtime of the copier.

SUMMARY OF THE INVENTION

It is therefore an object of the present invention to provide an improved pressure roller. It is another object of the invention to provide a pressure roller, the surface of which does not show any adhesion towards toner. A further object of the invention is the provision of a pressure roller having a surface which can be renewed without removing the pressure roller from the copier. The object is met in the present application by winding a tap spirally around the pressure roller to substantially cover a longitudinally medial working surface thereof. The tape is preferably made of a clinging plastic material such as a polyamide. Two clamping means respectively secure the ends of the tape to the roller. One end of the roller may be provided with a rotatable sleeve for facilitating winding of the tape about the roller.

DETAILED DESCRIPTION OF PREFERRED EMBODIMENTS

Figure 1:
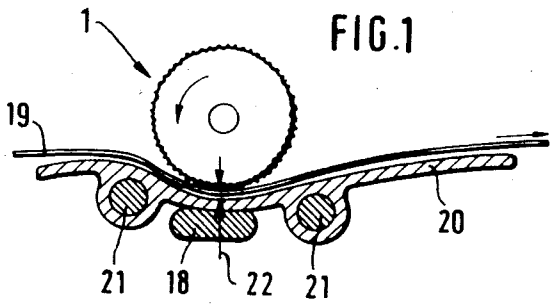
FIG. 1 is a diagrammatic lateral sectional view of a fixing device including a heater and an auxiliary heater which is in contact with the underside of a heating plate of the fixing device and a pressure roller.

According to the invention, a tape comprising a plastic material and having the form of a clinging tape is spirally wrapped around the surface of the roller from end to end thereof and the ends of the tape are fastened to clamping surfaces present at end portions of the roller.

In one embodiment of the invention, the clamping surfaces comprise quadrangular plane surfaces produced by milling the end portions of the roller, each of which is provided with a tapped blind hole. In a further aspect of the invention, clamping plates are shaped to be congruent with the clamping surfaces, and the tape can be screwed on to the roller by means of these clamping plates, each of which has a hole which is congruent with the corresponding tapped blind hole.

In a further aspect of the invention, the roller ends have different lengths and a clamping sleeve is slipped over the longer roller end and is mounted on a shaft, about which it is selectively rotatable. The clamping sleeve has the same outer diameter as the rest of roller and forms one end portion comprising the clamping surface of the roller. In the clamping sleeve, a tapped through-hole is present, into which a set screw is screwed in order to lock the clamping sleeve in its position on the shaft.

Each end of the tape is provided with a pair of mutually orthogonal diagonal edges to form an end which tapers to form a point. The two edges forming a pair have different lengths, with the longer edge forming an angle of about 30° with the longitudinal edge of the tape, and preferably form an angle of about 90° with respect to each other. Moreover, the pairs of edges at the tape ends are arranged to be skew-symmetric with respect to each other, i.e., symmetric upon rotation of one pair through 180° in the plane of the tape.

For fixing the tape on the clamping surfaces by means of the clamping plates, the tape is provided with a hole on an imaginary horizontal line passing through the pointed end of the tape, and the distance between the center of the hole and the pointed end of the tape is from 6 to 8 mm. The material of the tape may appropriately comprise a polyamide.

The invention has the advantage that the plastic tape, which is tightly wound around the roller, does not show any adhesion with respect to toner, so that soiling of the copy base by toner which has been entrained by the roller is, to a large extent, prevented, and the roller operates trouble-free for a longer period of time, compared with a conventional knurled aluminum roller having an anodized surface. It is also an advantage that the tape can be replaced without dismounting the roller, i.e., time is saved in such servicing operations.

Below, the invention is explained in detail with reference to an illustrative example shown in the drawings.

FIG. 1 shows one embodiment of the mechanical assembly of a fixing device. A heating plate 20 comprising, for example, cast aluminum, is equipped with two heating rods 21, 21 forming the main heat source and being embedded in the underside of the heating plate 20. An auxiliary heater 18 is arranged between these heating rods and is in contact with the underside of the heating plate 20. In a further embodiment, which is not shown, the auxiliary heater can likewise be embedded in the heating plate. The auxiliary heater can take the form of a plate, a cylinder, or any other suitable form.

Heating plates which are constructed as shown in FIG. 1 are, for example, used in Infotec brand photocopiers, distributed by KALLE Niederlassung der Hoechst AG, Wiesbaden, Federal Republic of Germany. Similar arrangements are used for modified forms of such heating plates.

As a result of the use of the bent or curved form of the heating plate 20, also called a "heating saddle", in combination with a surface-textured pressure roller 1, an intimate contact between the heating plate 20 and the passing copy sheet 19 is obtained. According to the state of the art, a fixing gap 22 which is present between the pressure roller 1 and the heating plate 20 has a width of about 2 mm.

The effect of rapid heating to ensure reliable, smear-resistant fixing and good fusion of the toner images on the copy sheet 19, even after a short on-time, is enhanced by a narrower fixing gap 22 made possible in the present invention, compared with the 2 mm gap in known fixing devices as just mentioned. The width of the fixing gap can be reduced to about 0.3 mm, without thereby impairing the passage of the copy sheets comprising paper or plastic film and without blurring the toner images on the copy sheets.

Figure 2:
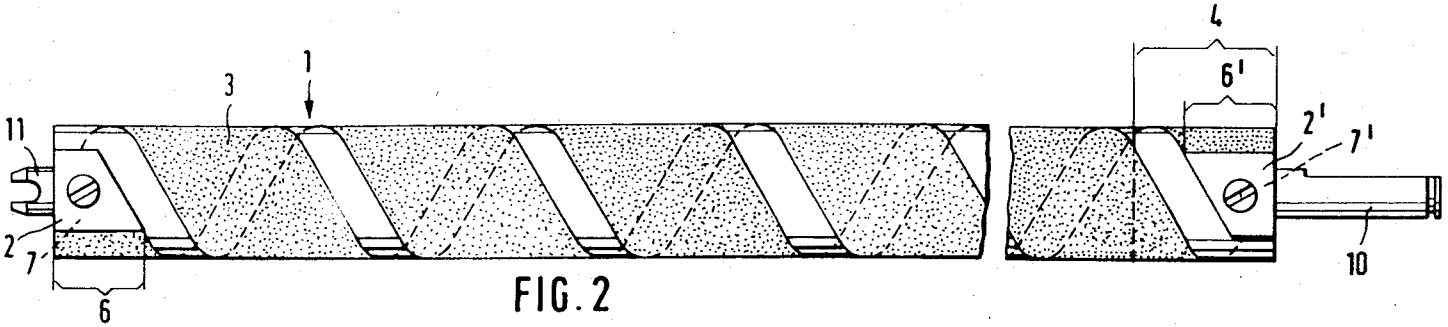
FIG. 2 is a plan view of a pressure roller according to the present invention, with a plastic tape wound around its surface.

As shown in FIG. 2, a plastic tape 3 in the form of a clinging tape is spirally wound around the surface of the roller 1 from end to end thereof. In end portions 6,6' of the roller 1, clamping surfaces 7,7' are present, on which the ends of the tape can be fastened by clamping, as will be described below.

The tape 3 comprises a ready-to-use clinging tape made, for example, of a polyamide. Other plastic materials are, however, also suitable for this purpose. The tape 3 is fastened by screwing it onto the roller 1 with the aid of clamping plates 2,2'. The clamping plates 2,2' are shaped to be congruent with the clamping surfaces 7,7' which comprise quadrangular plane surfaces produced by milling the end portions 6,6' of the roller. The clamping surfaces 7,7' can, for example, be constructed to have the form of a trapezoid.

Figure 3:
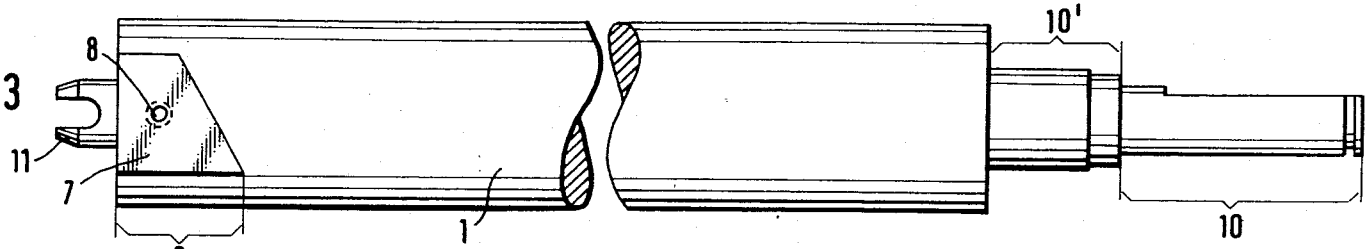
FIG. 3 is a plan view of the pressure roller of FIG. 2, from which the plastic tape and a clamping sleeve have been removed.

As can be seen from FIG. 3, the roller end 10 on the right is longer than the roller end 11 on the left of the roller. The left-hand roller end 11 has a recess which is, for example, engaged by a driving shaft, in a manner which is not shown in the drawing, in order to rotate the roller 1.

The left-hand end portion 6 of the roller 1 is provided with a tapped blind hole 8.

Figure 4:
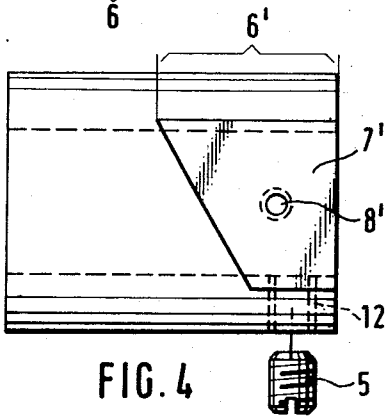
FIG. 4 is a detailed plan view showing the clamping sleeve of FIG. 2.

In the direction of the main body of the roller 1, the right-hand roller end 10 is shouldered off in two steps to produce a shaft 10' the diameters of which are greater than the diameter of the roller end 10. In operation, a clamping sleeve 4 (FIG. 2) is mounted on this shaft 10'. A plan view of the clamping sleeve 4 is shown in FIG. 4. The clamping sleeve 4 has the same outer diameter as the roller 1, and its outer surface forms the right-hand end portion 6' of the clamping surface 7'. The end portion 6' of the clamping surface 7' is provided with a tapped blind hole 8'. The wall of the clamping sleeve 4 is penetrated by a tapped through-hole 12 and a set screw 5 can be screwed into this tapped hole 12, in order to lock the clamping sleeve 4 in its position on the shaft 10'.

Figure 5:
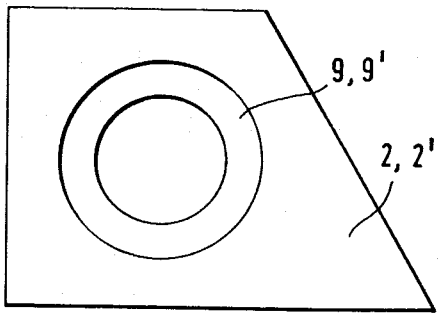
FIG. 5 is a plan view of a clamping plate of the pressure roller.

As shown in FIG. 5, each of the clamping plates 2,2' has a hole 9 or 9', respectively, which is congruent with the corresponding tapped blind hole 8 or 8', respectively, when the clamping plates are positioned on the clamping surfaces 7,7' of the roller 1.

Figure 6:
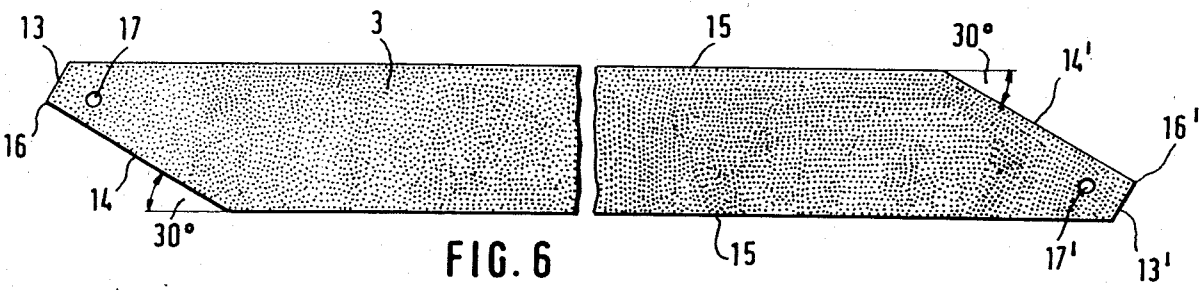
FIG. 6 is a plan view of the tape for the pressure roller.

The tape 3 can be fastened onto the roller 1 using the clamping plates 2,2', each of which has a hole 9 or 9', respectively, which is congruent with the tapped blind hole 8 or 8', respectively. FIG. 6 shows the tape 3, which has pairs of edges 13, 14 and 13', 14' at either end, which are tapered with respect to the longitudinal edges 15, 15 of the tape 3 and include an angle of 90° between them. The edges which, in each case, form a pair 13, 14 and 13', 14' have different lengths, and the longer edge 13 or 13', respectively, includes an angle of, for example, 30° with the longitudinal edge 15 of the tape 3. This angle can also be smaller than 30° or it may be in the range between 30° and 45°. It is only important that the angle formed between the edge pairs at the tape ends is invariably 90°. The pair of edges 13, 14 is arranged to be skew-symmetric with respect to the opposite pair of edges 13', 14', i.e. symmetric upon rotation of one pair through 180° in the plane of the tape 3. In the vicinity of the pointed ends 16', 16' of the tape 3, holes 17, 17' are present, which are located on the imaginary horizontal lines passing through the pointed ends 16, 16' and being parallel to the longitudinal edges 15, 15. The distance between the center of each hole and the pointed end of the tape is from about 6 to 8 mm. The tape 3 is screwed onto the roller 1 as follows:

First one end of the tape is screwed onto the clamping surface 7 with the aid of the left-hand clamping plate 2. Then the tape 3 is spirally wound around the roller 1 at an angle of 30°, in the direction of the opposite end of the roller 1 and is fastened on the clamping surface 7' which is present on the clamping sleeve 4 mounted on the shaft 10'. For this purpose, the right-hand clamping plate 2′ is used. Thereafter, the clamping sleeve 4 is rotated in the direction of winding, until the tape 3 is in close contact with the surface of the roller 1. The set screw 5 is then screwed down to lock the clamping sleeve 4 in its position on the shaft 10′. For replacing the tape 3, it is not necessary to dismount the roller 1 from the copier, since by performing the above-described steps in reverse order, the tape 3 can be removed from the surface of the roller 1, which is then ready to receive a fresh tape 3.

What is claimed is:

1. A roller for pressing a sheet against a heating surface, comprising:

a generally cylindrical roller;

a tape wound spirally around said roller and substantially covering a longitudinally medial working surface of said roller, said tape being made of a clinging plastic material;

two clamping means, one disposed at each end of said roller, each for clamping a respective end of said tape to a respective end of said roller, wherein each of said clamping means comprises a quadrangular planar surface on said roller, a blind hole in said planar surface and clamping plate shaped to be congruent with said planar surface and having a hole thereon aligned with said blind hole; and a clamping sleeve rotatably disposed around one end of the roller having a smaller diameter than said medial working surface.

2. A roller as claimed in claim 1, wherein said clinging plastic material comprises a polyamide.

3. A roller as claimed in claim 1, wherein said clamping sleeve has an outer diameter substantially equal to the diameter of said working surface, and wherein one of said clamping means is disposed on said clamping sleeve.

4. A roller as claimed in claim 3, wherein said clamping sleeve further comprises means for preventing said clamping sleeve from rotating with respect to said one end.

5. A roller as claimed in claim 4, wherein said rotation preventing means comprises a tapped through-hole in said clamping sleeve, and a set screw screwed into said tapped through hole.

6. A roller as claimed in claim 1, wherein said tape has two ends, each of which has a point formed by a junction of a pair of two mutually orthogonal diagonal edges.

7. A roller as claimed in claim 6, wherein said pair comprises two edges having mutually different lengths, the longer edge forming an angle of approximately 30° with a longitudinal edge of said tape, and wherein the pairs of edges at respective tape ends are arranged to form skew-symmetric pairs.

8. A roller as claimed in claim 6, wherein each of said tape ends further comprises structure defining a through hole longitudinally displaced from the respective point by a distance in the range of about 6 to 8 mm.

9. A fixing subassembly for a copying machine comprising:

a heating surface;

a generally cylindrical roller having a longitudinal medial working surface thereof covered with a tape wound spirally around said roller, said tape being made of a clinging plastic material; and a clamping sleeve having the same outer diameter as said roller, the wall of said clamping sleeve being penetrated by a tapped through-hole into which a set screw can be screwed, in order to lock the clamping sleeve in its position on the shaft of said roller.

10. A fixing subassembly as claimed in claim 9, wherein said roller further comprises two clamping means disposed respectively at each end of said roller, each for clamping an end of said tape to a respective end of said roller.

11. A fixing subassembly as claimed in claim 10, wherein each of said clamping means further comprises a clamping plate shaped to be congruent with a corresponding planar surface provided at each end of said roller and having a hole aligned with a blind hole provided in said planar surface.

* * * * *